US008960890B2

(12) United States Patent
Kondo et al.

(10) Patent No.: US 8,960,890 B2
(45) Date of Patent: Feb. 24, 2015

(54) PRINTING APPARATUS, PRINTING METHOD, AND PROGRAM

(75) Inventors: Takamitsu Kondo, Shiojiri (JP); Toru Takahashi, Azumino (JP); Kazuyoshi Tanase, Matsumoto (JP); Hiroshi Wada, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 70 days.

(21) Appl. No.: 13/426,316

(22) Filed: Mar. 21, 2012

(65) Prior Publication Data

US 2012/0242766 A1 Sep. 27, 2012

(30) Foreign Application Priority Data

Mar. 22, 2011 (JP) ..... 2011-063046

(51) Int. Cl.

| | |
|---|---|
| ***B41J 2/01*** | (2006.01) |
| ***B41M 7/00*** | (2006.01) |
| ***B41J 2/21*** | (2006.01) |
| ***B41J 11/00*** | (2006.01) |

(52) U.S. Cl.

CPC ..... *B41M 7/0081* (2013.01); *B41J 2/2132* (2013.01); *B41J 11/002* (2013.01)

USPC ..... 347/102

(58) Field of Classification Search

CPC ..... B41J 11/002

USPC ..... 347/6, 9, 15, 40–43, 101, 102, 20

IPC ..... B41J 2/01

See application file for complete search history.

(56) References Cited

U.S. PATENT DOCUMENTS

| | | | | |
|---|---|---|---|---|
| 5,748,207 | A * | 5/1998 | Inui et al. | 347/43 |
| 2002/0070990 | A1 | 6/2002 | Yamasaki et al. | |
| 2005/0219342 | A1 | 10/2005 | Kachi | |
| 2006/0181563 | A1 | 8/2006 | Niekawa | |
| 2007/0013759 | A1 * | 1/2007 | Kadomatsu et al. | 347/102 |
| 2010/0141696 | A1 * | 6/2010 | Fujisawa | 347/9 |
| 2010/0156971 | A1 * | 6/2010 | Ikeda et al. | 347/9 |
| 2010/0194838 | A1 * | 8/2010 | Mitsuzawa | 347/102 |
| 2010/0201771 | A1 | 8/2010 | Mitsuzawa | |
| 2012/0147109 | A1 | 6/2012 | Ohnishi | |

FOREIGN PATENT DOCUMENTS

| | | | |
|---|---|---|---|
| JP | 2000-158793 | A | 6/2000 |
| JP | 2002-292848 | A | 10/2002 |
| JP | 2005-041041 | A | 2/2005 |
| JP | 2005-288905 | A | 10/2005 |
| JP | 2005-324459 | A | 11/2005 |
| WO | 2006/018987 | A1 | 2/2006 |
| WO | 2011/021403 | A1 | 2/2011 |

* cited by examiner

*Primary Examiner* — Manish S Shah
*Assistant Examiner* — Roger W Pisha, II
(74) *Attorney, Agent, or Firm* — Maschoff Brennan

(57) ABSTRACT

A printing apparatus includes a nozzle that ejects, onto a medium, photo-curing ink cured when irradiated with light, and an irradiation unit that irradiates, with the light, the photo-curing ink landed on the medium. Here, when printing an image on the medium by coating with the photo-curing ink, the photo-curing ink is ejected from the nozzle so that the photo-curing ink is coated on the medium with a smaller amount of ink than normally coated in a region inside an outer border of the image, and the photo-curing ink is cured by irradiating the image with the light from the irradiation unit.

6 Claims, 13 Drawing Sheets

FIG. 3A
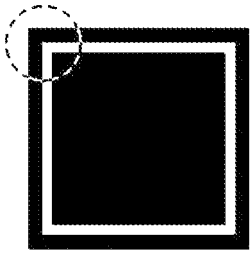
FIG. 3B
| | | | | | | | | | |
|---|---|---|---|---|---|---|---|---|---|
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 0 | 0 | 0 | 0 | 0 | 0 | 0 |
| 1 | 1 | 1 | 0 | 0 | 0 | 0 | 0 | 0 | 0 |
| 1 | 1 | 1 | 0 | 0 | 1 | 1 | 1 | 1 | 1 |
| 1 | 1 | 1 | 0 | 0 | 1 | 1 | 1 | 1 | 1 |
| 1 | 1 | 1 | 0 | 0 | 1 | 1 | 1 | 1 | 1 |
| 1 | 1 | 1 | 0 | 0 | 1 | 1 | 1 | 1 | 1 |
| 1 | 1 | 1 | 0 | 0 | 1 | 1 | 1 | 1 | 1 |
FIG. 3C
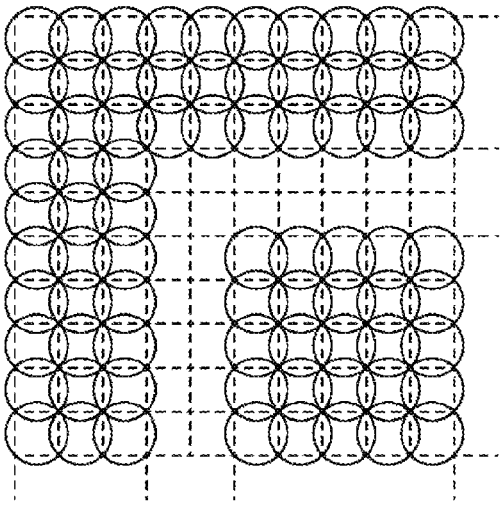

FIG. 9A

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |

FIG. 9B

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |

FIG. 9C

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |

FIG. 9D

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 0 | 0 | 0 | 0 | 0 | 0 | 0 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 1 | 1 | 1 | 1 | 1 | 1 | 0 | 1 | 1 | 0 | 0 |
| 0 | 0 | 1 | 1 | 0 | 0 | 0 | 0 | 0 | 0 | 0 | 0 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 1 | 1 | 1 | 1 | 1 | 1 | 1 | 1 | 1 | 1 | 1 | 1 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |

FIG. 11A

| | | | | | | | | | | | | | | | |
|---|---|---|---|---|---|---|---|---|---|---|---|---|---|---|---|
| 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 |

00 NO DOT-FORMING
01 SMALL DOT
10 INTERMEDIATE DOT
11 LARGE DOT

FIG. 11B

| | | | | | | | | | | | | | | | |
|---|---|---|---|---|---|---|---|---|---|---|---|---|---|---|---|
| 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 01 | 01 | 01 | 01 | 01 | 01 | 01 | 01 | 11 | 11 | 00 | 00 |
| 00 | 00 | 11 | 11 | 01 | 11 | 11 | 11 | 11 | 11 | 11 | 01 | 11 | 11 | 00 | 00 |
| 00 | 00 | 11 | 11 | 01 | 11 | 11 | 11 | 11 | 11 | 11 | 01 | 11 | 11 | 00 | 00 |
| 00 | 00 | 11 | 11 | 01 | 11 | 11 | 11 | 11 | 11 | 11 | 01 | 11 | 11 | 00 | 00 |
| 00 | 00 | 11 | 11 | 01 | 11 | 11 | 11 | 11 | 11 | 11 | 01 | 11 | 11 | 00 | 00 |
| 00 | 00 | 11 | 11 | 01 | 11 | 11 | 11 | 11 | 11 | 11 | 01 | 11 | 11 | 00 | 00 |
| 00 | 00 | 11 | 11 | 01 | 11 | 11 | 11 | 11 | 11 | 11 | 01 | 11 | 11 | 00 | 00 |
| 00 | 00 | 11 | 11 | 01 | 01 | 01 | 01 | 01 | 01 | 01 | 01 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 11 | 11 | 11 | 11 | 11 | 11 | 11 | 11 | 11 | 11 | 11 | 11 | 00 | 00 |
| 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 |

00 NO DOT-FORMING
01 SMALL DOT
10 INTERMEDIATE DOT
11 LARGE DOT

FIG. 13A

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |

0 WHITE

255 BLACK

FIG. 13B

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 127 | 127 | 127 | 127 | 127 | 127 | 127 | 127 | 255 | 255 | 0 | 0 |
| 0 | 0 | 255 | 255 | 127 | 127 | 127 | 127 | 127 | 127 | 127 | 127 | 255 | 255 | 0 | 0 |
| 0 | 0 | 255 | 255 | 127 | 127 | 255 | 255 | 255 | 255 | 127 | 127 | 255 | 255 | 0 | 0 |
| 0 | 0 | 255 | 255 | 127 | 127 | 255 | 255 | 255 | 255 | 127 | 127 | 255 | 255 | 0 | 0 |
| 0 | 0 | 255 | 255 | 127 | 127 | 255 | 255 | 255 | 255 | 127 | 127 | 255 | 255 | 0 | 0 |
| 0 | 0 | 255 | 255 | 127 | 127 | 255 | 255 | 255 | 255 | 127 | 127 | 255 | 255 | 0 | 0 |
| 0 | 0 | 255 | 255 | 127 | 127 | 127 | 127 | 127 | 127 | 127 | 127 | 255 | 255 | 0 | 0 |
| 0 | 0 | 255 | 255 | 127 | 127 | 127 | 127 | 127 | 127 | 127 | 127 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 255 | 255 | 255 | 255 | 255 | 255 | 255 | 255 | 255 | 255 | 255 | 255 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |

0 WHITE

255 BLACK

PRINTING APPARATUS, PRINTING METHOD, AND PROGRAM

CROSS-REFERENCE TO RELATED APPLICATIONS

This application claims priority to Japanese Patent Application No. 2011-063046 filed on Mar. 22, 2011. The entire disclosure of Japanese Patent Application No. 2011-063046 is hereby incorporated herein by reference.

BACKGROUND

1. Technical Field

The present invention relates to a printing apparatus, a printing method, and a program.

2. Related Art

A printing apparatus which ejects photo-curing ink (for example, ultraviolet (UV) ink) cured by irradiation of light (for example, ultraviolet light (UV) and visible light, etc.) is known. In the printing apparatus, light is irradiated to dots formed on a medium after ejecting UV ink from a nozzle to the medium. Thus, the dots are cured and then fixed on the medium (for example, see, JP-A-2000-158793).

Since the photo-curing ink hardly permeates the medium, dots constituting a print image are formed in relief when an image is printed using the photo-curing ink in comparison with when an image is printed using, for example, permeable ink (for example, aqueous ink).

In addition, the inventor of this application has found a phenomenon (the thick heap phenomenon) that a region close to edges of the print image is especially in relief in comparison with other parts thereof when an image is printed with the ink jet method using the photo-curing ink. Also, it has been found that, due to the thick heap phenomenon, the print image is visible three-dimensionally when the print image is visually perceptible in a state in which light is specularly reflected only in a part of the print image, so that the print image is perceived thicker than it actually is, resulting in deterioration in image quality of the print image.

SUMMARY

An advantage of some aspects of the invention is to provide a printing apparatus, a printing method, and a program in which image quality of an image printed with the ink jet method using photo-curing ink is improved.

According to an aspect of the invention, there is provided a printing apparatus, including: a nozzle that ejects onto a medium, photo-curing ink cured when irradiated with light; and an irradiation unit that irradiates, with the light, the photo-curing ink landed on the medium, wherein, when printing an image on the medium by coating with the photo-curing ink, the photo-curing ink is ejected from the nozzle so that the photo-curing ink is coated on the medium with a smaller amount of the ink than normally coated in a region inside an outer border of the image, and the photo-curing ink is cured by irradiating the image with the light from the irradiation unit.

BRIEF DESCRIPTION OF THE DRAWINGS

The invention will be described with reference to the accompanying drawings, wherein like numbers reference like elements.

FIGS. 3A to 3C are explanatory diagrams of overviews according to an embodiment of the present invention. Here, FIG. 3A is an explanatory diagram of a filled image on image data after performing a thinning process so as to suppress the thick heap phenomenon, FIG. 3B is an explanatory diagram of image data (pixel data) of a region indicated by a dotted line of FIG. 3A, and FIG. 3C is an explanatory diagram of a dot formed on a medium in accordance with the image data of FIG. 3B.

FIGS. 9A to 9D are explanatory diagrams of image data when a thinning process is performed.

FIGS. 11A and 11B are explanatory diagrams of image data when another thinning process is performed.

FIGS. 13A and 13B are explanatory diagrams of image data when a thinning process is performed before a halftone process is performed.

DESCRIPTION OF EXEMPLARY EMBODIMENTS

Figure 1A:
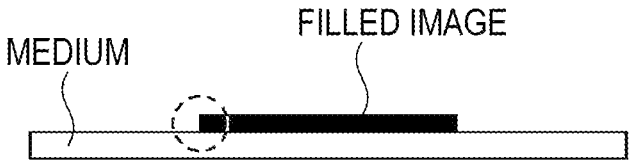
FIG. 1A is an explanatory diagram of a print image obtained when an image is printed on a medium using UV ink.

Hereinafter, exemplary embodiments of the invention will now be described in detail with reference to the accompanying drawings.

A printing apparatus includes a nozzle that ejects, onto a medium, photo-curing ink cured when irradiating with light, and an irradiation unit that irradiates, with the light, the photo-curing ink landed on the medium. Here, when printing an image on the medium by coating with the photo-curing ink, the photo-curing ink is ejected from the nozzle so that the photo-curing ink is coated on the medium with a smaller amount of the ink than normally coated in a region inside an outer border of the image, and the photo-curing ink is cured by irradiating the image with the light from the irradiation unit.

According to the printing apparatus, image quality of an image that is printed with the ink jet method using the photo-curing ink may be improved.

It is preferable that the amount of the ink to be coated on the medium is determined in accordance with the line width of the image. Since the thick heap phenomenon differs in accordance with the line width, the appropriate amount of ink differs in accordance with the line width.

It is preferable that the width of the outer border is determined in accordance with the line width. This is because the appropriate width of the outer border differs in accordance with the line width.

It is preferable that a test pattern is printed on the medium, and the amount of the ink is determined in accordance with the inspection results of the test pattern. From this, the appropriate amount of ink may be determined.

It is preferable that the image is printed on the medium that does not have an ink receiving layer. When an image is printed using the photo-curing ink in the ink jet method, a non-ink absorbing medium is particularly effective.

A printing method uses a nozzle that ejects, onto a medium, photo-curing ink cured when irradiated with light, and an irradiation unit that irradiates, with the light, the photo-curing ink landed on the medium. The printing method includes ejecting the photo-curing ink from the nozzle when printing an image on the medium by coating with the photo-curing ink, so that the photo-curing ink is coated on the medium with a smaller amount of the ink than normally coated in a region inside an outer border of the image, and curing the photo-curing ink by irradiating the image with the light from the irradiation unit.

According to the printing method, image quality of an image printed in the ink jet method using the photo-curing ink may be improved.

In a printing apparatus including a nozzle that ejects, onto a medium, photo-curing ink cured when irradiated with light, and an irradiation unit that irradiates, with the light, the photo-curing ink landed on the medium, a program includes a function of ejecting the photo-curing ink from the nozzle so that the photo-curing ink is coated on the medium with a smaller amount of the ink than normally coated in a region inside an outer border of an image when printing the image on the medium by coating with the photo-curing ink, and a function of curing the photo-curing ink by irradiating the image with the light from the irradiation unit.

According to this program, image quality of an image that is printed with the ink jet method using the photo-curing ink may be improved.

Overview

Thick Heap Phenomenon and Thick Heap Perception

Since a medium such as a plastic film has the property that the medium hardly absorbs ink, UV ink may be used as the photo-curing ink when performing printing on the medium in the ink jet method. The UV ink is ink having the property that the UV ink is cured when ultraviolet rays are irradiated. Dots are formed by curing the UV ink, so that printing may be performed even on the medium which does not have the ink receiving layer and ink absorbing property.

However, the dot formed of the UV ink is in relief on the outer surface of the medium, so that unevenness is formed on the outer surface of the medium when a print image is formed on the medium using the UV ink. When the print image is a filled image, the print image has thickness.

FIG. 1A is an explanatory diagram of a print image obtained when an image is printed on a medium using UV ink.

Since the UV ink hardly permeates the medium, dots are in relief when an image is printed using the UV ink. When an image (a filled image) is printed, the dots formed of the UV ink fill a predetermined region, so that the print image having thickness is formed on the medium. For example, when characters are printed on the medium, a character image (an example of a filled image) having thickness is formed on the medium. The thickness of the image printed using the UV ink is about several μm.

Figure 1B:
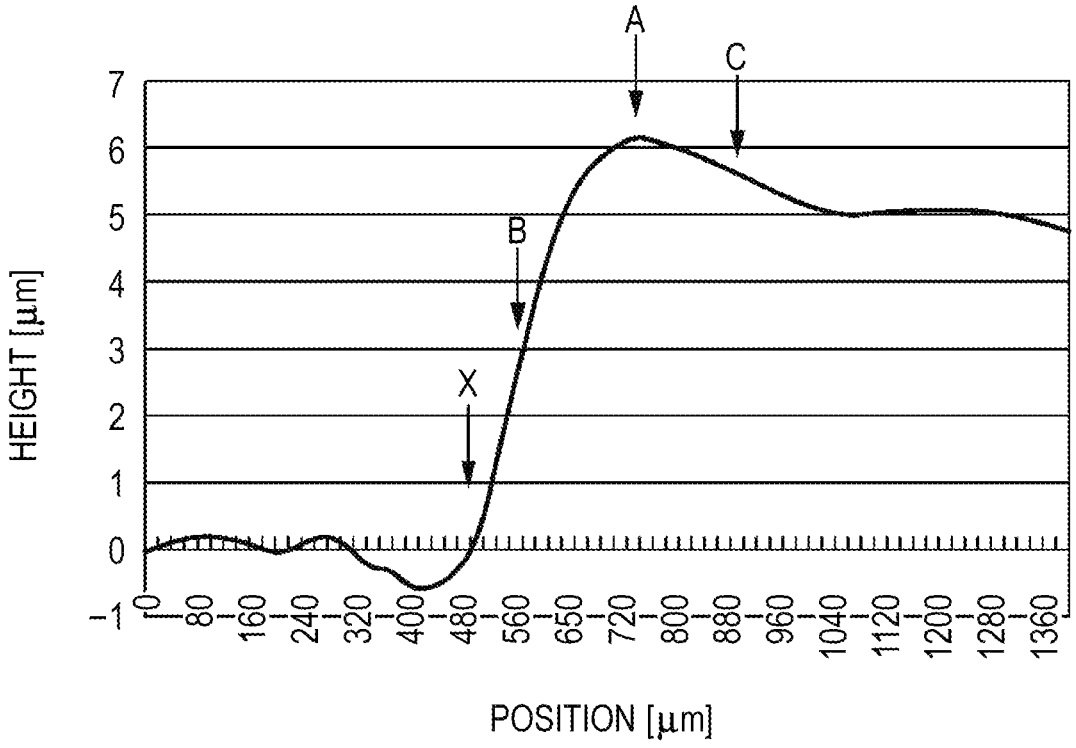
FIG. 1B is a graph illustrating measurement values of the thickness of a region (near the edge) indicated by the dotted line of FIG. 1A.

FIG. 1B is a graph illustrating a measurement value of a thickness of a region (near the edge) indicated by a dotted line in FIG. 1A. A horizontal axis of the graph indicates the position of the medium, and a vertical axis thereof indicates the height of the dots (the thickness of the print image). Also, the print image is an image that was printed out at a printing resolution of 720×720 dpi by forming a dot with a weight of ink of 10 ng. The thickness of the print image was measured using a Quick Vision Stream plus, a non-stop CNC image measuring machine manufactured by Mitutoyo Corporation. As shown in the figure, the print image has a thickness of about 5 μm.

A position X in the graph indicates an outermost position of the print image. That is, the position X indicates the position of the edge (border) of the print image. In addition, a position A indicates the thickest position (the highest position) in the vicinity of the edge of the print image. In other words, the position A indicates a position of a relief portion in the vicinity of the edge of the print image.

The position A is located in an inner side from the position X by about 200 μm. In a region (a region B in the graph) between the position X and the position A, the print image is inclined to become progressively thicker toward the inside of the print image. Scales in the vertical and horizontal directions in the graph do not match; however, the inclination in the region B of the graph is actually at an angle of less than 3 degrees. In addition, in the region (the region C in the graph) inside the print image from the position A, the print image gradually becomes thinner toward the inside, and the when the thickness reaches about 5 μm, the thickness becomes uniform.

In the present specification, as in the position A in the graph, a phenomenon in which the region close to the edge is especially in relief in comparison with other parts is referred to as "the thick heap phenomenon". The "thick heap phenomenon" is a unique phenomenon occurring when an image is printed in the ink jet method using the UV ink.

The mechanism in which the thick heap phenomenon occurs is not clear, however, it may be considered roughly as follows. The UV ink has a higher viscosity than that of permeable ink, however, has liquidity enough to be ejected from the nozzle in the ink jet method (in this manner, the point in which the liquidity enough to be ejected from the nozzle is required is a unique characteristic different from ink that is used in a plate making printing). The UV ink has liquidity until the UV ink is completely cured by irradiating the UV ink with ultraviolet rays even after being landed on the medium. It is considered that the thick heap phenomenon occurs in the region close to the edge of the print image due to the effect of the liquidity after being landed.

Figure 2A:
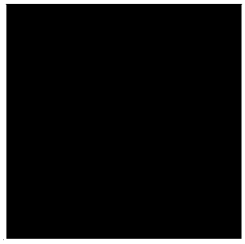
FIG. 2A is a diagram illustrating the print image of FIG. 1A viewed from above.
Figure 2B:
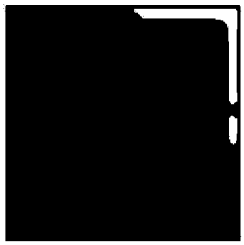
FIG. 2B is an explanatory diagram of a state in which light is specularly reflected in a part of the print image of FIG. 2A.

FIG. 2A is a diagram illustrating the print image of FIG. 1A viewed from above, and FIG. 2B is a view describing a state in which light is specularly reflected in a part of the print image of FIG. 2A. In FIG. 2B, a part which is shiny and visually perceptible inside the print image is indicated with white.

At the center portion of the print image, the thickness is almost uniform, thereby obtaining uniform gloss. However, in the region close to the edge of the print image, the thickness is not uniform, thereby failing to obtain the uniform gloss.

The print image does not have a uniform thickness due to the thick heap phenomenon in the region close to the edge, so that a relief portion is formed inside relative to the edge (border) of the print image along the edge. As a result, it can be confirmed visually that a part of the print image is shiny along the edge depending on the reflection angle of light as shown in FIG. 2B. From an observer's eye, depending on the light source, the positional relationship and angle of the print image, light specularly reflected from the inclined region of FIG. 1B enters the observer's eye, and the print image is visually perceptible as shown in FIG. 2B.

As shown in FIG. 2B, when a part of the print image is seen shining along the edge, the entire print image is perceived three-dimensionally. To give a comparative example, when the brightness of a part of a three-dimensional object is displayed brightly on a two dimensional image on a display in computer graphics (for example, such as when the three-dimensional object is rendered as a two-dimensional image by ray tracing), the print image is perceived three-dimensionally. As a result, despite the fact that the print image has a thickness of about 5 μm, an observer of the print image may perceive the print image as being thicker.

In this specification, the phenomenon by which the print image is perceived as being thicker than the actual thickness of the print image due to the thick heap phenomenon is referred to as "thick heap perception". The problem of "thick heap perception" is a unique problem occurring when an image is printed with the ink jet method using UV ink.

In addition, the print image of a typical plate making printing (flexographic printing, offset printing, or the like) has little thickness in comparison with an image printed using UV ink. Therefore, in the print image by the typical plate making printing, the "thick heap phenomenon" does not occur, and the problem of "thick heap perception" does not arise. Also, a print image printed in a manner such that ink permeates the medium has little thickness. Therefore, the "thick heap phenomenon" does not occur even in the print image printed in a manner such that the ink permeates the medium, and the problem of "thick heap perception" does not arise. Thus, the thick heap phenomenon or thick heap perception is a unique phenomenon and a problem occurring when the image is printed in the ink jet method using the UV ink.

Overview of the Present Embodiment

FIGS. 3A to 3C are explanatory diagrams of overviews according to an embodiment of the invention. Here, FIG. 3A is an explanatory diagram of a filled image based on image data after performing a thinning process so as to suppress the thick heap phenomenon, FIG. 3B is an explanatory diagram of image data (pixel data) of the region indicated by a dotted line in FIG. 3A, and FIG. 3C is an explanatory diagram of a dot formed on a medium in accordance with the image data of FIG. 3B.

In the present embodiment, by thinning pixels inside an image while leaving the outer border of the image, the thick heap phenomenon is suppressed. Further, "thinning" or the "thinning process" means that a smaller amount of ink than normally coated is coated (dots are formed), or otherwise that the image data is processed so as to form these dots. As described below, not forming the dot in a pixel in which the dot is to be normally formed, or forming a dot having a smaller size than normally formed are included in the thinning process.

In FIG. 3B, a pixel in which pixel data is converted by the thinning process is indicated by bold lines. In FIGS. 3B and 3C, the thinning process is performed with three "outer border lines" and two "thinning lines". "The thinning line" is a line in which the thinning process is performed. Thus, "the number of thinning lines" is a value indicating the width of the region in which the thinning process is performed. "The outer border line" is a line positioned on the outside of the thinning line. Thus, "the number of the outer border lines" is a value indicating the width of the outer border, that is, the region outside the region in which the thinning process is performed. Appropriate values for the number of outer border lines and the number of thinning lines is determined by an inspection process which will be described later.

In FIG. 3C, since a dot is not formed in a region of the thinning line, a gap is formed while the UV ink is not coated, however, the UV ink gets wet and spreads on the medium after being landed on the medium, so that the UV ink is coated even on the region of the thinning line. Thus, as shown in FIG. 3A, even though the gap is opened on the image data, the print image printed on the medium is an image filled using the UV ink.

By the thinning process of the present embodiment, the amount of ink coated on a region close to the edge of the print image is reduced, and the height of the position A of FIG. 1B is lowered. Thus, the thick heap phenomenon or thick heap perception may be suppressed.

Basic Configuration

First, a basic configuration of the printing apparatus for implementing the thinning process will be described. In addition, the printing apparatus of the present embodiment is a device for printing, on a medium, an image in which the thinning process has been performed. For example, an apparatus (system) including a printer 1 which will be described below, and a computer 110 in which a printer driver is installed corresponds to the printing apparatus. A controller 10 of the printer 1 and the computer 110 form the control unit for controlling the printing apparatus.

Figure 4:
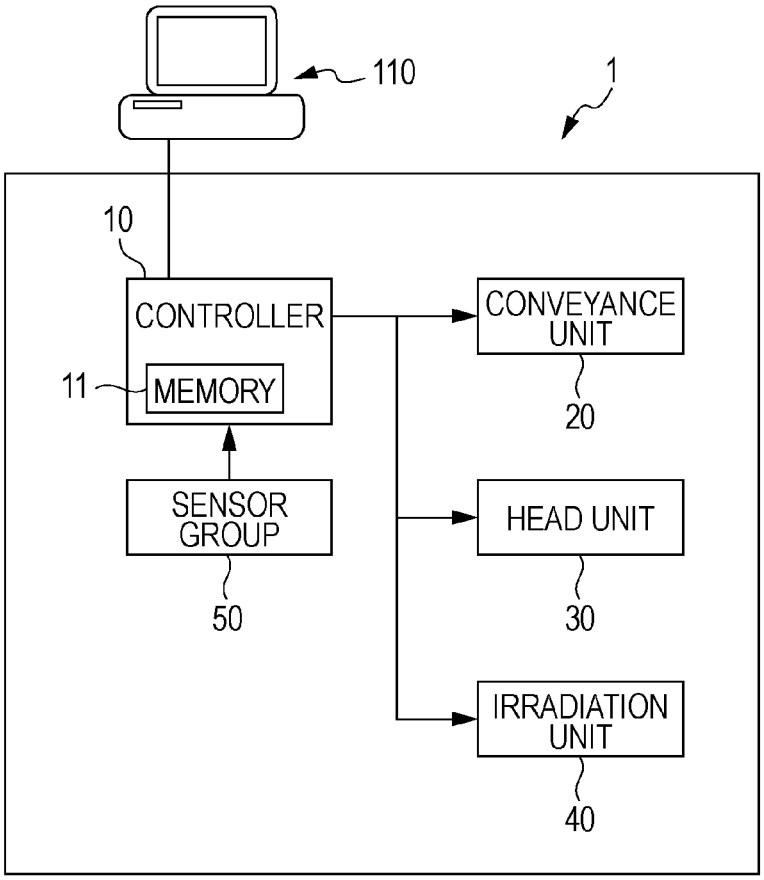
FIG. 4 is a block diagram illustrating an overall configuration of a printer.
Figure 5:
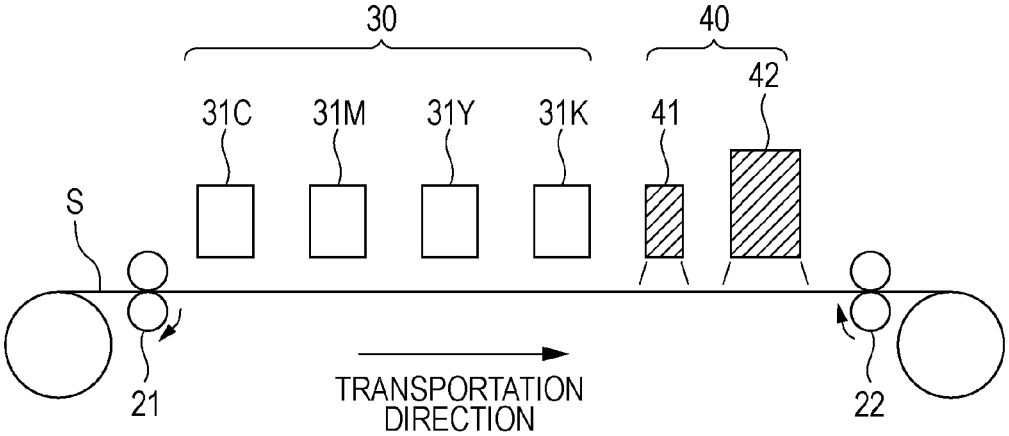
FIG. 5 is an explanatory diagram of an overall configuration of a printer.

FIG. 4 is a block diagram illustrating an overall configuration of a printer 1, and FIG. 5 is an explanatory diagram of an overall configuration of the printer 1. The printer 1 of the present embodiment is a so-called line printer. However, the printer 1 may be a so-called serial printer (a printer in which a head is mounted in a carriage movable in a paper width direction) which is different from the line printer.

The printer 1 includes the controller 10, a transportation unit 20, a head unit 30, an irradiation unit 40, and a sensor group 50. The printer 1 that receives print data from the computer 110 that is a print control device controls each unit (the transportation unit 20, the head unit 30, the irradiation unit 40, and the like) by the controller 10.

The controller 10 is a control device for performing control of the printer 1. The controller 10 controls each unit in accordance with a program stored in a memory 11. In addition, the controller 10 controls each unit based on the print data received from the computer 110 to print an image on a medium S. A variety of detection signals detected by the sensor group 50 are input to the controller 10.

The transportation unit 20 is used for transporting the medium S (for example, paper, film, and the like) in a transportation direction. The transportation unit 20 includes a transportation motor (not shown), an upstream side roller 21, and the downstream side roller 22. When the transportation motor which is not shown is rotated, the upstream side roller 21 and the downstream side roller 22 are rotated, and the roller-shaped medium S is transported in the transportation direction.

The head unit 30 is used for ejecting ink onto the medium S. The head unit 30 includes a cyan head group 31C for ejecting cyan ink, a magenta head group 31M for ejecting magenta ink, a yellow head group 31Y for ejecting yellow ink, and a black head group 31K for ejecting black ink. Each of the head groups includes a plurality of heads arranged in the paper width direction (a direction vertical to a paper surface in FIG. 5), and each of the heads includes a plurality of nozzles arranged in the paper width direction. Thus, each head group may form, at one time, dots across the full paper width. When ink is ejected from the head unit 30 toward the medium S which is transported in the transportation direction, a two-dimensional print image is formed on a printing surface of the medium S.

In the present embodiment, UV ink is ejected from each nozzle of the head unit 30. The UV ink is ink having a property of being cured when irradiated with ultraviolet rays. In addition, the UV ink has a property of having a high viscosity in comparison with permeable ink for performing printing by permeating the ink into the medium. For this reason, even when printing is performed on, for example, plain paper, the UV ink is hardly absorbed into the medium in comparison with the permeable ink. Since the UV ink cures dots and settles the cured dots on the medium, printing may be performed even though the medium does not have, for example, an ink receiving layer or ink absorbency.

The irradiation unit 40 is used to irradiate the UV ink ejected to the medium S with ultraviolet rays. The irradiation unit 40 has an initial curing irradiation unit 41 and a main curing irradiation unit 42.

The initial curing irradiation unit 41 is provided in the downstream side in a transportation direction of a print region (downstream side in a transportation direction of the head unit 30). The initial curing irradiation unit 41 irradiates with ultraviolet rays having intensity capable of curing (initial curing) an outer surface of the UV ink so that the UV ink landed on the medium S is not blurred. For example, as the initial curing irradiation unit 41, an LED (Light Emitting Diode), or the like may be adopted.

Further, in the present embodiment, a single initial curing irradiation unit is provided in the downstream side in the transportation direction of the head unit 30, however, the initial curing irradiation unit may be provided in the downstream side in the transportation direction of each of the four head groups.

The main curing irradiation unit 42 is provided in the downstream side in the transportation direction of the initial curing irradiation unit 41. The main curing irradiation unit 42 irradiates with ultraviolet rays having an intensity capable of main curing (completely curing) the UV ink on the medium. For example, as the main curing irradiation unit 42, a UV lamp, and the like is adopted.

When performing printing, the controller 10 transports the medium S to the transportation unit 20 in the transportation direction. The controller 10 forms dots on the medium by ejecting the UV ink to the head unit 30 while transporting the medium S, initially cures the dots formed of the UV ink by irradiating with the ultraviolet rays from the initial curing irradiation unit 41, and completely cures the dots by irradiating with the ultraviolet rays from the main curing irradiation unit 42.

The computer 110 is communicably connected with the printer 1, and outputs print data to the printer 1 corresponding to an image to be printed so as to have the printer 1 print the image.

In the computer 110, a printer driver is installed. The printer driver is a program for converting image data output from an application program into print data. The printer driver is recorded on a recording medium (computer-readable recording medium) such as CD-ROM. The printer driver may be downloaded to the computer 110 via the Internet.

Thinning Process

Inspection Process

Before performing the thinning process, it is necessary that the number of outer border lines and the number of thinning lines are determined in advance. Therefore, test patterns having the number of outer border lines or the number of thinning lines which are different from each other are printed by the printer 1. By selecting the test pattern having optimized image quality from the test patterns, the number of outer border lines and the number of thinning lines suitable for the thinning process are determined.

Figure 6:
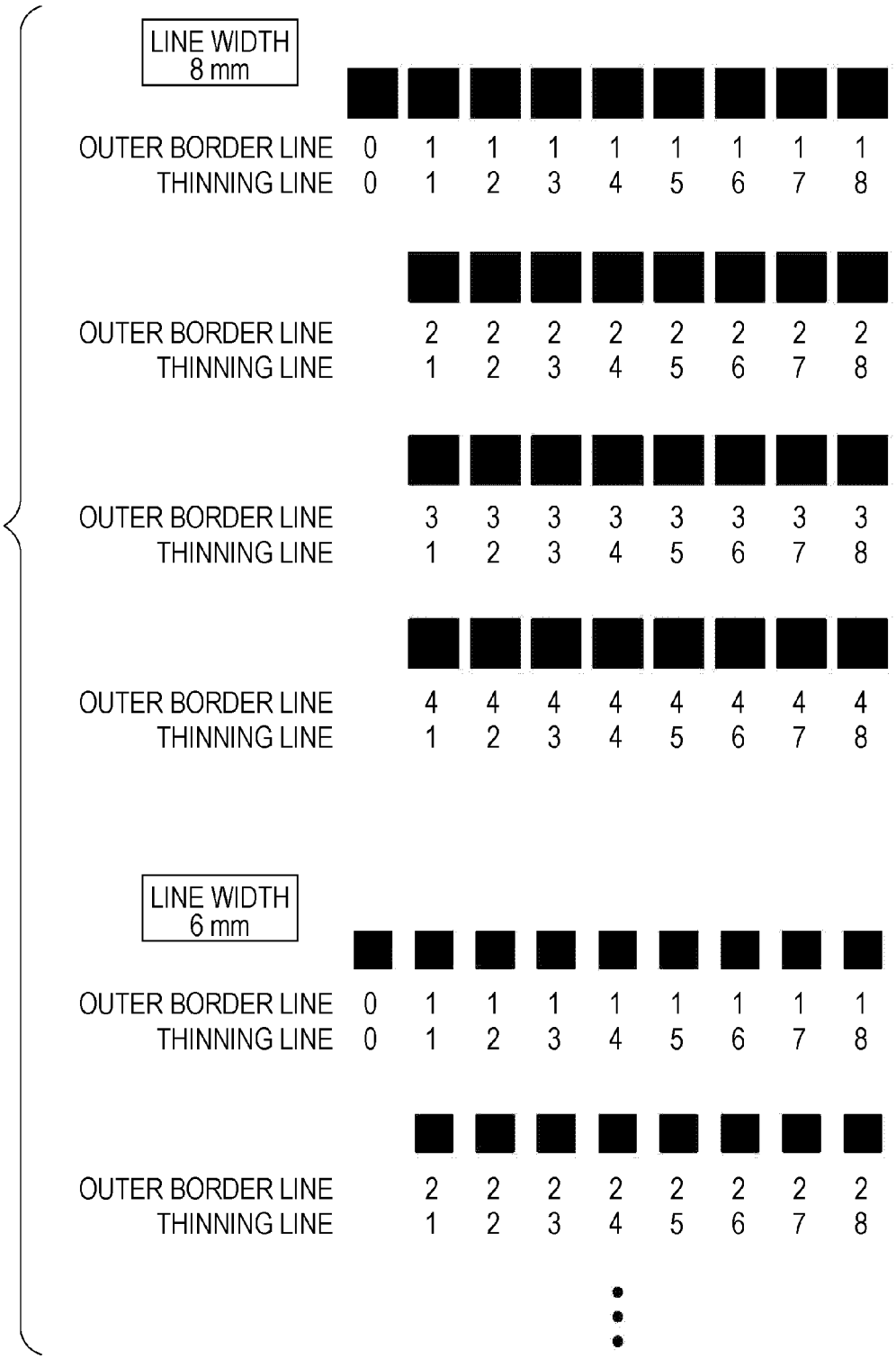
FIG. 6 is an explanatory diagram of a test pattern.

FIG. 6 is an explanatory diagram of a test pattern. The printer 1 prints a plurality of test patterns shown in FIG. 6 on the medium.

Each of the test patterns includes a rectangular pattern, a display of the number of outer border lines, and a display of the number of thinning lines. Although not shown, a thinning process is performed on the rectangular pattern. The number of outer border lines or the number of thinning lines in which the thinning process is performed with respect to the rectangular pattern is the number displayed below each of the rectangular patterns as is.

The rectangular pattern in an upper left side of FIG. 6 (a rectangular pattern in which the number of outer border lines is zero, and the number of thinning lines is zero) corresponds to a case in which a filled image is printed as is. Consequently, the rectangular pattern in the upper left side is a print image on which the thinning process is not performed. Typically, the thick heap phenomenon occurs in the rectangular pattern in the upper left side, and the rectangular pattern in the upper left side is perceived as being thicker than the actual thickness thereof.

The thinning line becomes thicker by the rectangular pattern in the right side of FIG. 6.

When the thinning line is significantly thin, there is the risk that the thick heap phenomenon cannot be suppressed. In this case, a gloss along an edge inside the rectangular pattern is visually perceptible, so that there is the risk that thick heap perception remains. It cannot be said that the number of thinning lines in the rectangular pattern in which thick heap perception remains is optimized. Meanwhile, when the thinning line is significantly thick, a gap (thinning line) inside the rectangular pattern may be visually perceptible although not shown. The number of thinning lines in the above described rectangular pattern also deteriorates image quality, so that it cannot be said that the number of thinning lines is optimized. From this reason, a plurality of test patterns in which the number of thinning lines is changed is provided.

In addition, in the rectangular patterns in a vertical direction of FIG. 6, the number of outer border lines thereof is different from each other. This is because the thickest position exists inside an edge of a print image in the thick heap phenomenon so that the degree of suppressing the thick heap phenomenon may be considered to be different to correspond to the number of outer border lines. In other words, this is because the degree of suppressing the thick heap phenomenon may be considered to be different in accordance with a position of the thinning line even though the number of thinning lines is the same. From this reason, a plurality of test patterns in which the number of outer border lines is changed is provided.

In addition, test patterns having different line widths are respectively formed. For example, each of the test patterns of four rows in the upper side of FIG. 6 is a rectangular pattern of 8 mm square, however, a rectangular pattern of 6 mm square is also formed in the lower side of FIG. 6. This is because the optimized number of outer border lines or the optimized number of thinning lines may be considered to be different in accordance with the line width. For example, it is considered that since the amount of the ink coated on the medium is small when the line width is thin, the thick heap phenomenon is reduced in comparison with when the line width is thick, thereby reducing the number of thinning lines. For this reason, a plurality of test patterns in which the line width is different are provided.

An inspector selects the rectangular pattern in which the thick heap perception does not occur and a gap inside the rectangular pattern does not exist (can not visually perceive the thinning line) by observing the respective rectangular patterns. That is, the inspector selects an optimized rectangular pattern by observing both "the gloss" and "the color" of the rectangular pattern. When the test patterns having a plurality of line widths exist, the inspector selects the optimized rectangular pattern for each line width. Next, the inspector inputs, to the computer 110, the number of outer border lines or the number of thinning lines corresponding to the selected test pattern to thereby store the input number in a storage device of the computer 110 or the memory 11 of the printer 1.

By the inspection process described as above, a table that associates the number of outer border lines with the number of thinning lines for each line width is stored in the storage device of the computer 110 or the memory 11 of the printer 1. When the thick heap phenomenon is different due to different mediums, the table may be additionally provided for each medium.

In addition, a method of selecting the optimized test pattern is not be limited to a sensory test carried out by the inspector.

For example, a thickness of the rectangular pattern is detected, and an optimized test pattern may be selected based on the detected result. When measuring the thickness of the rectangular pattern, Quick Vision Stream plus, that is, a non-stop CNC image measuring machine manufactured by Mitutoyo Corporation which has been used in the measurement in FIG. 1B may be used. When selecting, from among the respective measurement results of the plurality of rectangular patterns, the rectangular pattern in which a region close to the edges is not in relief in comparison with other parts as shown in the position A of FIG. 1B, or the test pattern in which the thickest thickness in the region close to the edges is within a predetermined range based on an average thickness of other parts, the rectangular pattern in which the thick heap perception does not occur may be selected. In addition, when selecting the rectangular pattern in which an extremely thin part inside the rectangular pattern does not exist, the rectangular pattern in which a gap inside the rectangular pattern does not exist (can not visually perceive the thinning line) may be selected. When the optimized test pattern is selected based on the thickness measurement results of the rectangular patterns, an average value of a plurality of measurement points close to the edges and a variation (standard deviation) are calculated, and the optimized test pattern may be selected based on the calculated average value and the variation.

In addition, as another method of selecting the optimized test pattern, specular reflection light is detected from the rectangular pattern, and a width of the detected line of the specular reflection light may be measured. That is, the rectangular pattern in which the thick heap perception does not occur may be selected based on the measurement value of the width of the line of the specular reflection light as shown in FIG. 2B. In the case of this selection method, by reading an image of the rectangular pattern using a scanner, and the like separately from the detection of the specular reflection light so as to perform an image analysis, the rectangular pattern in which the gap inside the rectangular pattern does not exist (can not visually perceive the thinning line) may be selected.

The above described inspection process may be performed in a manufacturing plant of the printer 1, or by a user of the printer 1.

Printing Process

When printing of an image drawn on an application program is directed by the user of the printer 1, the printer driver of the computer 110 starts. The printer driver receives image data from the application program, converts the received image data into print data having a format that can be interpreted by the printer 1, and outputs the print data to the printer. When converting the image data from the application program into the print data, the printer driver performs a resolution conversion process, a color conversion process, a halftone process, and the like. In addition, the printer driver of the present embodiment performs the above described thinning process.

Figure 7:
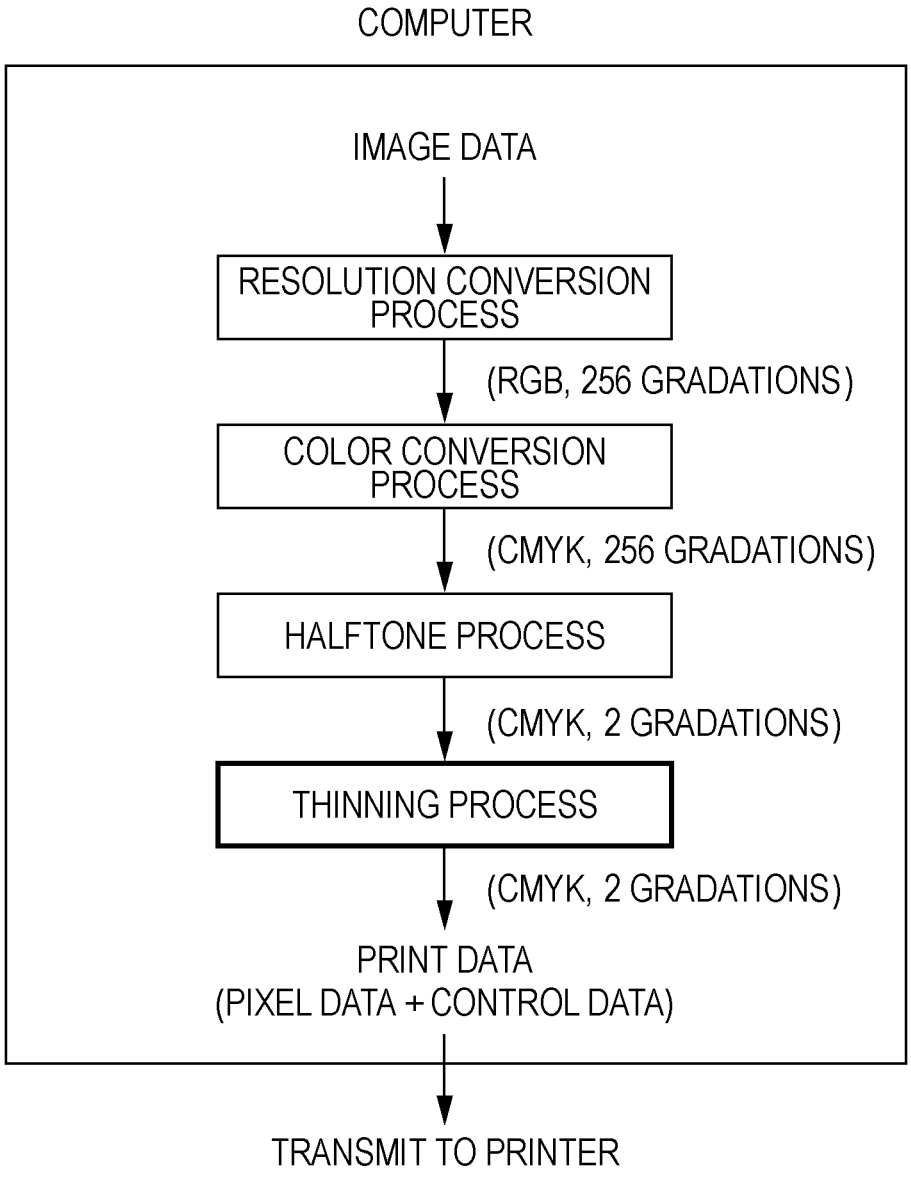
FIG. 7 is an explanatory diagram of a function of a printer driver of a computer.

FIG. 7 is an explanatory diagram of a function of a printer driver of a computer 110.

The resolution conversion process is a process that converts image data (text data, image data, and the like) output from the application program to image data having a resolution (print resolution) printed on the medium. For example, when the printing resolution is 720×720 dpi, the image data of a vector format that is received from the application program is converted into image data of a bitmap format having a resolution of 720×720 dpi. Each pixel data of the image data obtained after performing the resolution conversion process is RGB data of multi-gradation (for example, 256 gradations) indicated by an RGB color space.

The color conversion process is a process that converts the RGB data into CMYK data displayed in CMYK color space. In addition, the CMYK data is data corresponding to a color of ink of the printer. The color conversion process is performed based on a table (color conversion lookup table LUT) that associates a gradation value of the RGB data with a gradation value of the CMYK data. In addition, pixel data obtained after performing the color conversion process is CMYK data of 256 gradations indicated by the CMYK color space.

The halftone process is a process that converts data of the high number of gradations into data of the number of gradations that can be formed by the printer. For example, data indicating 256 gradations by the halftone process is converted into 1-bit data indicating 2 gradations by the halftone process. Pixel data of 1-bit corresponds to, for each pixel, the image data obtained after performing the halftone process. The pixel data of 1-bit becomes data indicating presence and absence of a dot. In addition, when the pixel data is 2-bit data, the pixel data may indicate a size of the dot as well as the presence and absence of the dot. In any case, the pixel data obtained after performing the halftone process becomes data indicating a dot to be formed on the medium.

As shown in FIG. 3B, the thinning process is a process that converts pixel data indicating that a dot is formed in the region close to the edges of the image into pixel data indicating that the dot is not formed.

Figure 8:
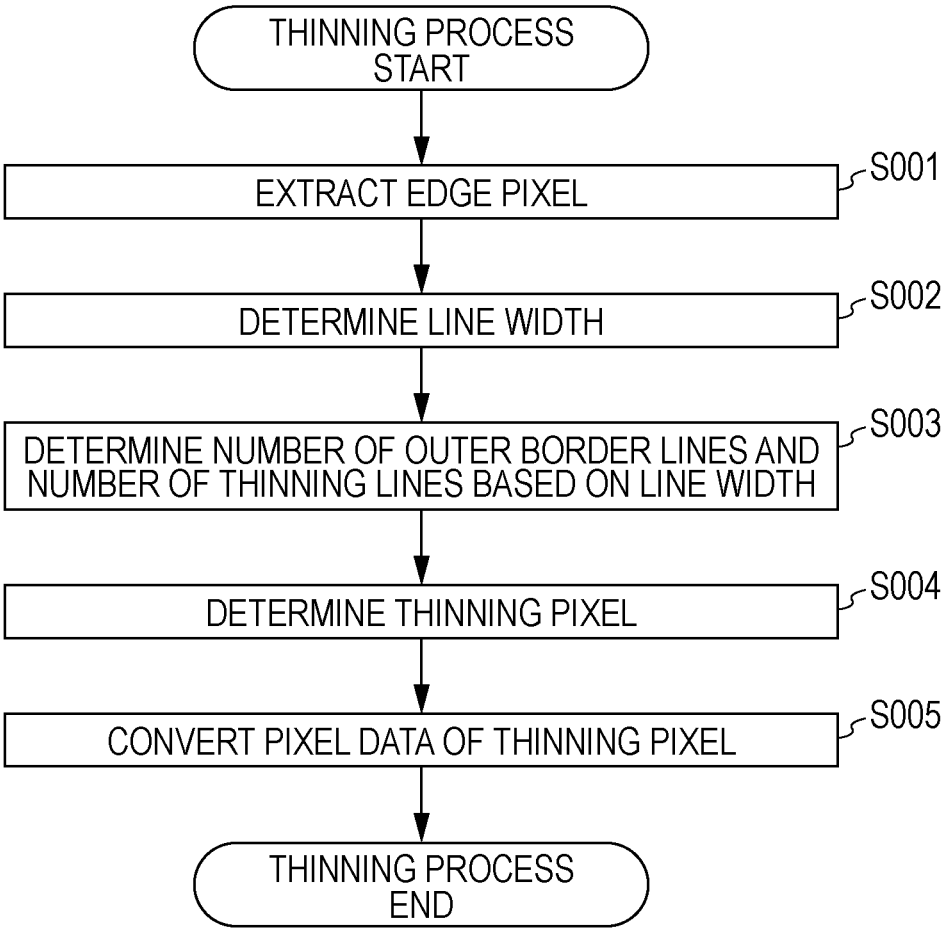
FIG. 8 is a flowchart illustrating a thinning process of FIG. 7.

FIG. 8 is a flowchart illustrating a thinning process of FIG. 7, and FIGS. 9A to 9D are explanatory diagrams of image data. FIG. 9A is an explanatory diagram of image data obtained after performing the halftone process. Here, it is assumed that pixel data of 1-bit may be associated for each pixel. In addition, it is assumed that a filled image of 12×12 pixels is included in the image data. Here, only black image data will be described; however, the same process is performed with respect to image data of other colors.

The printer driver performs an edge extraction process with respect to the image data (see, FIG. 9A) obtained after performing the halftone process to thereby extract edge pixels located in a border of the image (see, 5001 of FIG. 8). Here, a pixel is extracted as the edge pixel indicated by a thick border of FIG. 9B.

Next, the printer driver determines the line width of the image based on an interval between the edge pixels in an X direction or a Y direction (see, 5002 of FIG. 8). Here, the printer driver determines the line width as 12 pixels based on the interval between the edge pixels indicated by the thick border of FIG. 9B. In addition, when the intervals between the edge pixels in the X direction (horizontal direction in FIG. 9B) and the Y direction (vertical direction in FIG. 9B) are different, the line width is determined based on the narrower interval. This is because the line width is incorrectly determined when determining the line width based on the wider interval, for example, in a case in which the image is a laterally long line.

Next, the printer driver determines the number of outer border lines and the number of thinning lines based on the line width (see, 5003 of FIG. 8). In the above described inspection process, the table that associates the line width with the number of outer border lines and the number of thinning lines is stored in the computer 110, so that the printer driver determines the number of outer border lines and the number of thinning lines based on the table. Here, the number of outer border lines is determined as "2", and the number of thinning lines is determined as "1".

Next, the printer driver determines thinning pixels in accordance with the determined number of outer border lines and the determined number of thinning lines (see, 5004 of FIG. 8). Here, since the number of outer border lines is "2", and the number of thinning lines is "1", pixels indicated by a thick border of FIG. 9C become the thinning pixels. As shown in FIG. 9C, the thinning pixels may be associated with pixel data "1" indicating that a dot is formed.

Next, the printer driver converts the pixel data that can be associated with the thinning pixels from "1" to "0" (see, 5005 of FIG. 8). That is, the printer driver converts the pixel data "1" indicating that the dot is formed into pixel data "0" indicating that the dot is not formed. Here, pixel data of a thinning pixel indicated by a thick border of FIG. 9D is converted from "1" into "0".

The computer 110 generates print data by adding control data to pixel data of two gradations obtained after performing a thinning process, and transmits the generated print data to the printer 1 (see, FIG. 7). The printer 1 controls each unit in accordance with the control data included in the print data, and at the same time, ejects UV ink from each nozzle of the head unit 30 in accordance with each pixel data, and prints an image on the medium.

The printer 1 ejects the UV ink from each nozzle of the head unit in accordance with pixel data shown in FIG. 9D to thereby form dots on the medium. That is, an image on which the thinning process is performed when the number of outer border lines is 2, and the number of thinning lines is 1 is printed on the medium. Consequentially, the UV ink is coated inside the image using a smaller amount of the ink than normally coated, so that the image is printed.

The dot is not formed in pixels of the thinning line, however, when the appropriate number of outer border lines or the appropriate number of thinning lines is set, the UV ink gets wet and spreads from an adjacent region (a region of the outer border line or a region inside the thinning line) before the UV ink is irradiated with ultraviolet rays to be cured, so that the region of the thinning line is also filled by the UV ink.

Next, the printer 1 irradiates an image with ultraviolet rays from the initial curing irradiation unit 41 and the main curing irradiation unit 42. Thus, the image formed of the UV ink is cured, and the print image is settled on the medium.

Figure 10:
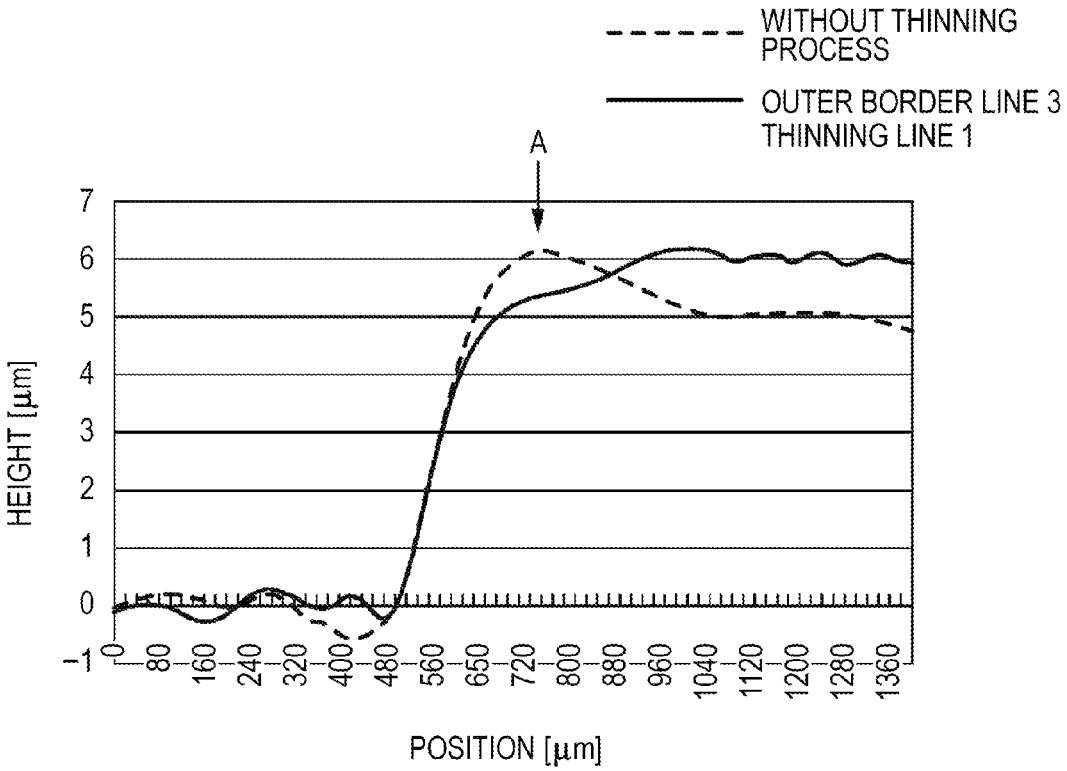
FIG. 10 is a graph illustrating a measurement value of a thickness of a region close to edges of a filled image.

FIG. 10 is a graph illustrating a measurement value of a thickness of a region close to edges of an image. The graph shown by a solid line indicates measurement values when a thinning process is performed. The graph shown by a dotted line indicates a measurement values when the thinning process is not performed, and is the same as that of FIG. 1B. In addition, a print image is a filled image having a printing resolution of 720×720 dpi by forming dots when a weight of the ink is 10 ng. A thickness of the print image is measured using Quick Vision Stream plus, that is, a non-stop CNC image measuring machine manufactured by Mitutoyo Corporation. In addition, in the thinning process, the number of outer border lines is 3, and the number of thinning lines is 1.

When performing the thinning process, in the position A in which the thick heap phenomenon occurs, the thick heap phenomenon with high relief is suppressed in comparison with other parts. In addition, a gap caused by performing the thinning process may not be generated.

Therefore, even though the print image is observed, thick heap perception is not generated, and the gap is not visually perceptible.

According to the present embodiment, an image is printed using a smaller amount of the ink than normally coated inside the image. Thus, the thick heap phenomenon is suppressed, so that thick heap perception when the print image is viewed is suppressed.

Another Embodiment

Another Thinning Process 1 (when Pixel Data is 2-Bit)

In the above described embodiment, the thinning process is performed so that a dot is not formed in a pixel in which the dot is to be normally formed, thereby suppressing the thick heap phenomenon. However, the invention is not limited thereto.

FIG. 11A is an explanatory diagram of image data obtained after performing a halftone process. Here, pixel data obtained after performing the halftone process is 2-bit data which is different from 1-bit data. When the 2-bit pixel data is "00", this means that a dot is not formed, when the 2-bit pixel data is "01", this means that a small dot is formed, when the 2-bit pixel data is "10", this means that an intermediate dot is formed, and when the 2-bit pixel data is "11", this means that a large dot is formed.

FIG. 11B is an explanatory diagram of image data obtained after performing the thinning process. Here, pixel data of a thinning pixel indicated by a thick border is converted from "11 (large dot)" to "01 (small dot)". That is, the pixel data is converted so that a dot smaller than normally formed is formed.

Even in the above described thinning process, an image is printed using a smaller amount of the ink than normally coated inside the image. Thus, the thick heap phenomenon is suppressed, so that thick heap perception when the print image is viewed is suppressed.

Another Thinning Process 2 (Thinning Process Before Halftone Process)

In the above described embodiment, a thinning process is performed with respect to image data obtained after performing a halftone process. In other words, the thinning process is performed with respect to the image data indicating a formation state of a dot. However, the invention is not limited thereto.

Figure 12:
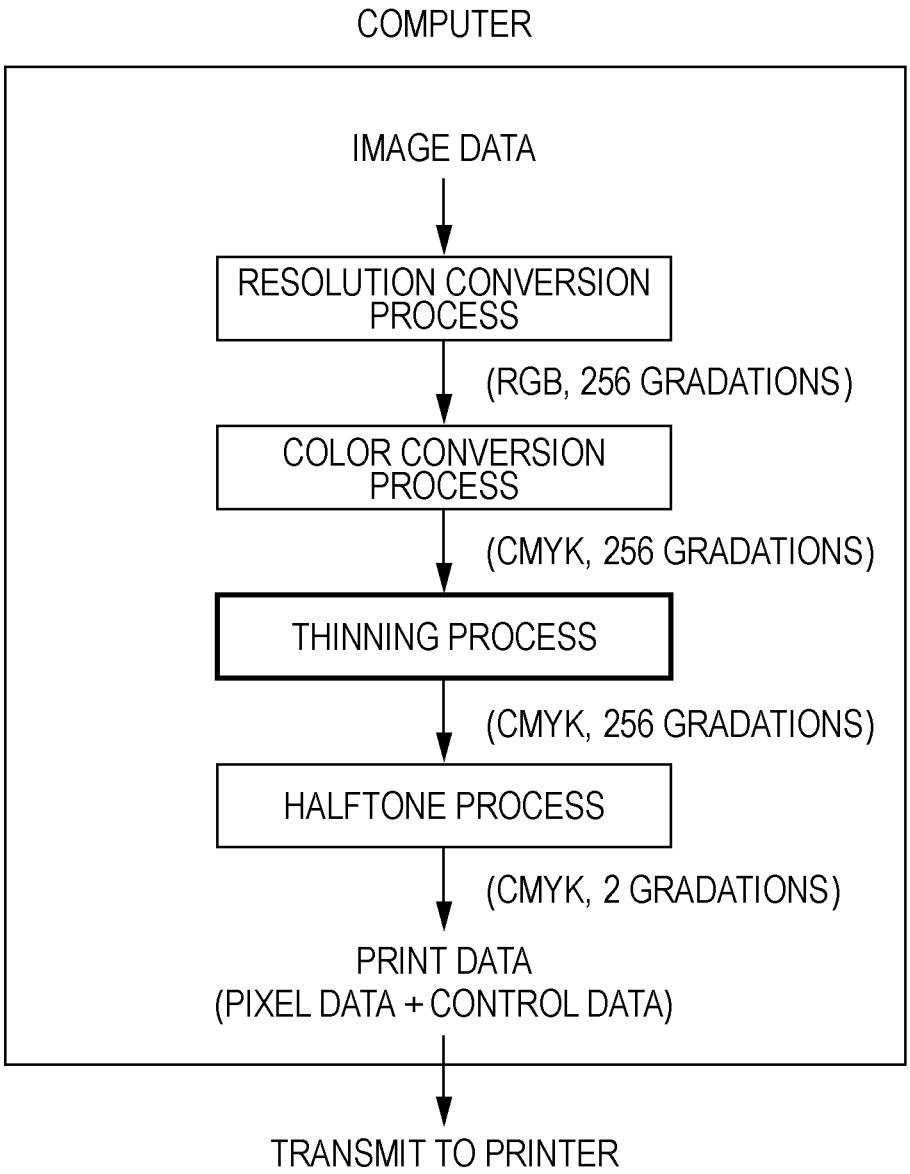
FIG. 12 is an explanatory diagram of another process of a printer driver.

FIG. 12 is an explanatory diagram of another processing of a printer driver. As shown in FIG. 12, a thinning process is performed immediately after a color conversion process and before the halftone process.

FIG. 13A is an explanatory diagram of image data obtained before performing a halftone process. Since the image data is image data obtained after performing a color conversion process, 8-bit image data indicating 256 gradations corresponds to each pixel. Here, a white color is shown when pixel data is "0", and a black color is shown when the pixel data is "255", so that a darker gray color is shown along with an increase in the value of the pixel data.

FIG. 13B is an explanatory diagram of image data obtained after performing a thinning process. Here, pixel data of a thinning pixel indicated by a thick border is converted from "255 (black)" to "127 (gray)".

When the printer 1 prints an image in accordance with image data obtained by performing a halftone process with respect to image data obtained after performing the thinning process, an image is printed using a smaller amount of the ink than normally coated inside the image. Thus, the thick heap phenomenon is suppressed, so that thick heap perception when a print image is viewed is suppressed.

Another Test Pattern

In the above described embodiments, the rectangular pattern is formed, however, the invention is not limited thereto.

Figure 14:
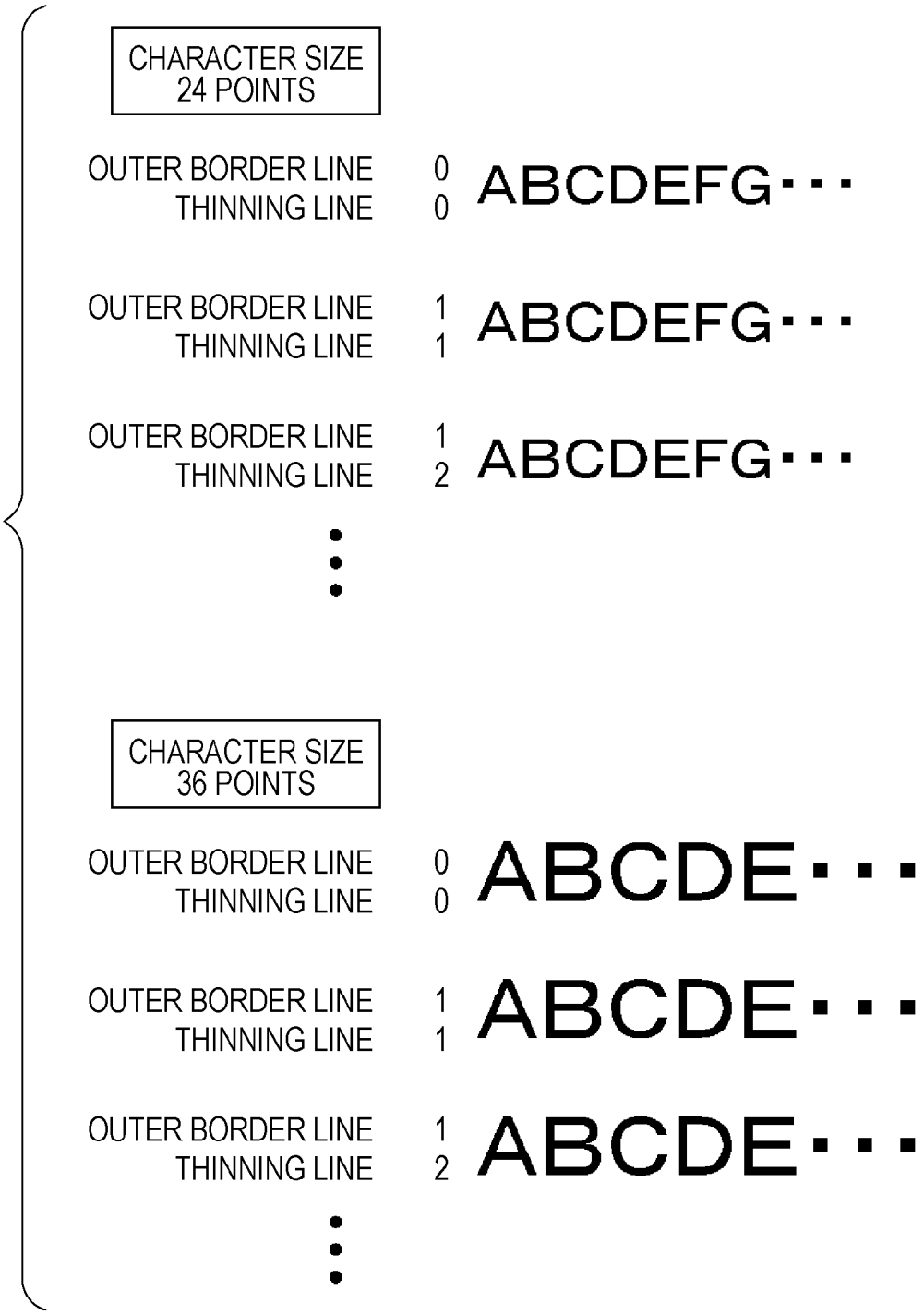
FIG. 14 is an explanatory diagram of another test pattern.

FIG. 14 is an explanatory diagram of another test pattern. In the present embodiment, a character image is printed as the filled image, instead of the rectangular pattern. Thus, in the inspection process, the character image is printed on the medium, and thick heap perception of the printed character image or image quality thereof is evaluated, so that the optimized number of outer border lines or the optimized number of thinning lines may be determined. In addition, it is preferable that a plurality of test patterns having different character sizes is formed in the same manner so that a plurality of test patterns having different line widths in the above described test pattern. In this case, a table that associates the number of outer border lines with the number of thinning lines is stored for each character size.

Other Embodiments

The above described embodiments are intended to facilitate understanding of the invention, and are not intended to be construed as limiting the invention. The invention can be modified and improved departing from the sprit of the invention, and at the same time, equivalents thereof will be included in the invention.

Filled Image

A filled image on image data before the above described thinning process is an image in which a dot is formed in all pixels. However, the invention is not limited thereto. The filled image may be an image in which a predetermined region of a medium is painted out using ink, and may be an image including a pixel in which a dot is not formed in a part.

Line Printer

The printer 1 described as above is a so-called line printer. In the printer 1, a medium is transported to a fixed head, and a dot row is formed in a transportation direction on the medium. However, the printer 1 is not limited to the line printer. For example, a printer in which a head is provided in a carriage movable in a main scanning direction, and a printer (so-called a serial printer) in which a dot formation operation of forming dots in the main scanning direction by ejecting UV ink from a moving head and a transportation operation of transporting a medium are alternatively repeated may be used.

In the case of the serial printer, it is possible to form a dot row at an interval narrower than a nozzle pitch. That is, it is possible to increase a printing resolution higher than that of the nozzle pitch. Therefore, a resolution of the above described image data may not be the same resolution as that of the nozzle pitch, and may be higher than that of the nozzle pitch.

Process of Computer 110

The above described computer 110 performs a resolution conversion process, a color conversion process, a halftone process, a thinning process, and the like. A part or all of these processes may be performed in the printer 1 side. When the thinning process performed by the computer 110 is performed at the printer side instead, the printer 1 may print singly, on the medium, an image on which the thinning process has been performed, so that the printer 1 alone corresponds to the "printing apparatus".

What is claimed is:

1. A printing apparatus comprising:

a nozzle that ejects photo-curing ink onto a medium, the photo-curing ink being cured when irradiated with light;

an irradiation unit that irradiates, the photo-curing ink ejected on to the medium with the light; and a controller which controls the nozzle and the irradiation unit to form an image on the medium based on image data, wherein, the controller performs a conversion process setting a first region and a second region located outside the first region on the image data, and converting ink amount of the first region to be smaller than the ink amount of the original image data; and wherein the controller performs the conversion process in accordance with the line width of the image.

2. The printing apparatus according to claim 1, wherein the controller determines a line of width of the first region in accordance with the line width of the image.

3. The printing apparatus according to claim 1, wherein a test pattern is printed on the medium, and the ink amount is determined in accordance with the results of the test pattern.

4. The printing apparatus according to claim 1, wherein the image printed on the medium does not have an ink receiving layer.

5. A printing method which uses a nozzle that ejects, onto a medium, photo-curing ink based on image data, the photo-curing ink being cured when irradiated with light, and an irradiation unit that irradiates the photo-curing ink landed on the medium with light, the printing method comprising:

a conversion process setting a first region and a second region located outside the first region on the image data, and converting ink amount of the first region to be smaller than the ink amount of the original image data is performed; and wherein the conversion process is performed in accordance with the line width of the image.

6. A non-transitory computer-readable storage medium storing a program in a printing apparatus including a nozzle that ejects, onto a medium, photo-curing ink cured when irradiated with light, and an irradiation unit that irradiates, with the light, the photo-curing ink landed on the medium, the program comprising:

a function of performing a conversion process setting a first region and a second region located outside the first region on the image data, and converting ink amount of the first region to be smaller than the ink amount of the original image data; and a function of performing the conversion process in accordance with the line width of the image.

* * * * *